US006216400B1

(12) United States Patent
Helton et al.

(10) Patent No.: US 6,216,400 B1
(45) Date of Patent: Apr. 17, 2001

(54) PREFABRICATED HEADERS

(76) Inventors: Richard Lee Helton, 536 Helton La.; David Carl Helton, 279 Helton La., both of Booneville, AR (US) 72927

( * ) Notice: Subject to any disclaimer, the term of this patent is extended or adjusted under 35 U.S.C. 154(b) by 0 days.

(21) Appl. No.: 09/429,710

(22) Filed: Oct. 29, 1999

(51) Int. Cl.[7] ..... E06B 1/04
(52) U.S. Cl. ..... 52/204.1; 52/731.2
(58) Field of Search ..... 52/731.2, 730.7, 52/732.1, 737.6, 204.1

(56) References Cited

U.S. PATENT DOCUMENTS

| | | | | |
|---|---|---|---|---|
| 1,891,187 | | 12/1932 | Plym . | |
| 2,316,425 | | 4/1943 | Hasenburger et al. . | |
| 2,936,051 | * | 5/1960 | Martin | 52/731.2 X |
| 3,079,649 | * | 3/1963 | Willatts | 52/731.2 X |
| 3,103,262 | * | 9/1963 | Handley | 52/731.2 X |
| 4,336,678 | * | 6/1982 | Peters | 52/730.7 X |
| 4,843,777 | * | 7/1989 | Shimabukuro | 52/730.7 X |
| 5,074,092 | * | 12/1991 | Norlander | 52/730.7 X |
| 5,625,996 | * | 5/1997 | Bechtel | 52/731.2 |
| 5,653,080 | * | 8/1997 | Bergeron | 52/730.7 X |
| 5,689,922 | | 11/1997 | Daudet . | |
| 5,802,782 | | 9/1998 | Jewell . | |
| 5,966,894 | * | 10/1999 | Crump, Jr. | 52/730.7 X |

FOREIGN PATENT DOCUMENTS

| | | | | |
|---|---|---|---|---|
| 605065 | * | 5/1926 | (FR) | 52/737.6 |
| 120991 | * | 12/1918 | (GB) | 52/731.2 |
| 58440 | * | 5/1946 | (NL) | 52/731.2 |

* cited by examiner

*Primary Examiner*—Jose V. Chen
(74) *Attorney, Agent, or Firm*—Patent & Trademark Services; Thomas Zack; Joseph H. McGlynn

(57) ABSTRACT

A prefabricated load-bearing header. An outer frame in the form a rectangle has four 2 by 4 boards joined together at their meetings ends at 45 degree angles. Within the inner perimeter of the outer frame are two sets of grooves extending lengthwise of each frame member. Two webbing supports extends across the opened formed inner perimeter of the frame and are joined to the inner interior of the frame near its mid point at one end and the corners at the other ends. These webbing supports provide increased strength to the frame structure. Covering the webbing supports are two sheets of chip board material cut to fit within the two sets of formed framing member grooves along the edges of the sheets. The grooves have a width approximately the same as the thickness of the sheets of chip boards which fit into them. The length of the framing members can be made to any desired length. After the framing members are joined together at their ends and the webbing supports are fixed to their joined inner perimeter, the two sheets of chip boards are fixed within the grooves of the frame to form an inexpensive, strong, light weight header using much less material than the conventional 2 by 12 headers commonly used above door and window openings in construction.

6 Claims, 4 Drawing Sheets

PREFABRICATED HEADERS

BACKGROUND OF THE INVENTION

This invention relates to a prefabricated header used in the construction industry. Headers are load bearing devices that are installed on the top of building openings. They may be used over openings for doors, windows or wherever there is a need to provide strength to support the wall, floor, roof and other structural elements above the opening.

For years headers have commonly been constructed by workmen on the job site. One widely used method has been to cut two 2 inch by 12 inch boards to the length required and then to nail the two boards together with a ½ inch chip board of the same length sandwiched between. The resulting load bearing header is a board 3.5 inches thick which is the normal thickness of the wall. Another reason 2 by 12 boards (actually 1.5 inches by 11.5 inches) are used to construct headers is that the 11.2 inch height when nailed flush to the top of an eight foot high wall gives a height opening suitable for a standard sized manufactured door.

Other prior art bulkheads or headers have metallic moldings with a series of sections whose edges are overlapped by an edge of an adjacent section with a retaining member between the edges. With one other prior art reference the header for a door frame is prefabricated with a horizontal lintel bar and vertically spaced strips joined by several short strips. Side bolts through the side strips are used to attach the lintel bar to the upper ends of stud sections.

Another prior art reference discloses a one piece light-gauge metal load-bearing header with a tube-shaped box beam. Still another prior art reference has a header with interlocking side end flanges, one of which is one each vertical studs, which sides end flanges can be joined together.

DESCRIPTION OF THE PRIOR ART

Load-bearing headers used in construction have been constructed in a vary of ways. For example, in the U.S. Pat. No. 1,891,187 to Plym there is disclosed a metallic moldings with a series of sections whose edges are overlapped by an edge of an adjacent section with a retaining member between the edges.

U.S. Pat. No. 2,316,425 to Hasenburger et al. discloses a header for a door frame which is prefabricated and has a horizontal lintel bar and vertically spaced strips joined by several short strips. Side bolts through the side strips are used to attach the lintel bar to the upper ends of stud sections.

U.S. Pat. No. 5,802,782 to Jewell discloses a one piece light-gauge metal load-bearing header with a tubeshaped box beam.

U.S. Pat. No. 5,689,922 to Daudet discloses a header with interlocking side end flanges, one of which is one each vertical studs, which sides end flanges can be joined together.

The present invention is a load-bearing prefabricated header having an outer frame with interior webbing material for strength and inserted chipboards all as will be detailed in the specification that follows hereafter.

SUMMARY OF THE INVENTION

This invention relates to prefabricated load-bearing headers used in the construction industry that use less lumber and material and are lighter in overall weight than conventional job site constructed headers.

It is the primary object of the present invention to provide for the improved construction of prefabricated headers.

Another object is to provide for such headers that are lighter and use less lumber than conventionally job site constructed headers yet have sufficient strength to bear the loads on them.

These and other objects and advantages of the present invention will become apparent to readers from a consideration of the ensuing description and the accompanying drawings.

DESCRIPTION OF THE PREFERRED EMBODIMENT

Figure 1:
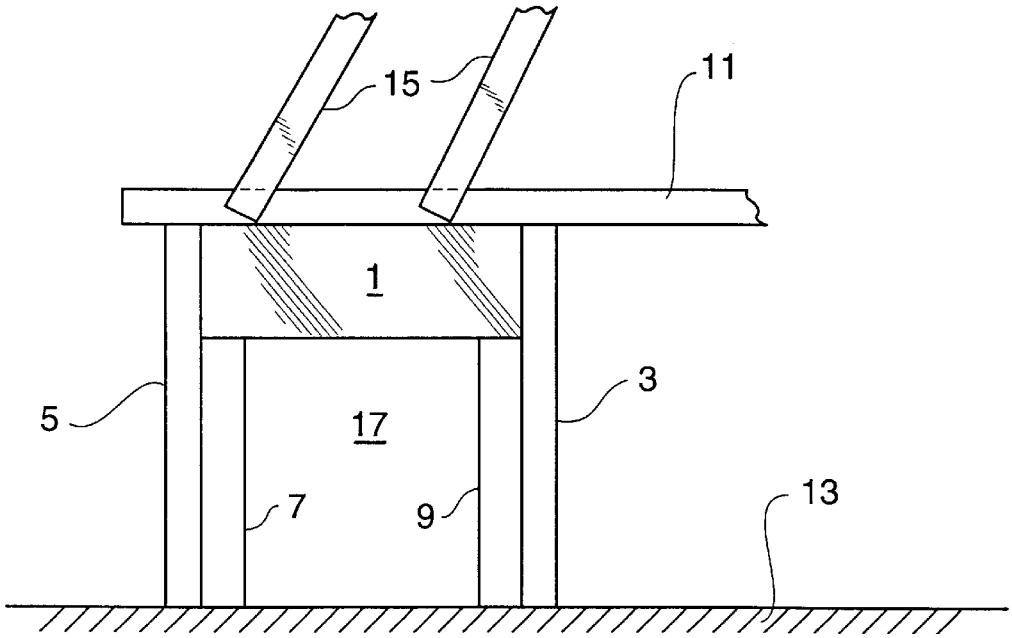
FIG. 1 PRIOR ART
FIG. 1 is a front view of one prior art commonly used type of header constructed on site.

FIG. 1 is a front view of one prior art commonly used type of header 1 constructed on the job site. In this view the header is horizontally and vertically supported by two outer wall studs 3 and 5 that extend to the ceiling and two shorter inner wall studs 7 and 9 that fit under the ends of the header. Above the header 1 is the horizontal board 11 defining the top of the wall or ceiling. Below the supporting four vertical studs in the floor 13. Roof rafter boards 15 are also depicted in this view. The opening 17 over which the header provides load-bearing support may be for window or for a door. Since the header's function is to provide such support it must have sufficient strength to withstand the loads placed on it from above without sagging or breaking. As stated before, one of the most common job site construction techniques is to use two 2 by 12 boards spanning the horizontal length between the wall studs 3 and 5 with a chip board or pressed fiber board between the two 2 by 12 inch boards.

Figure 2:
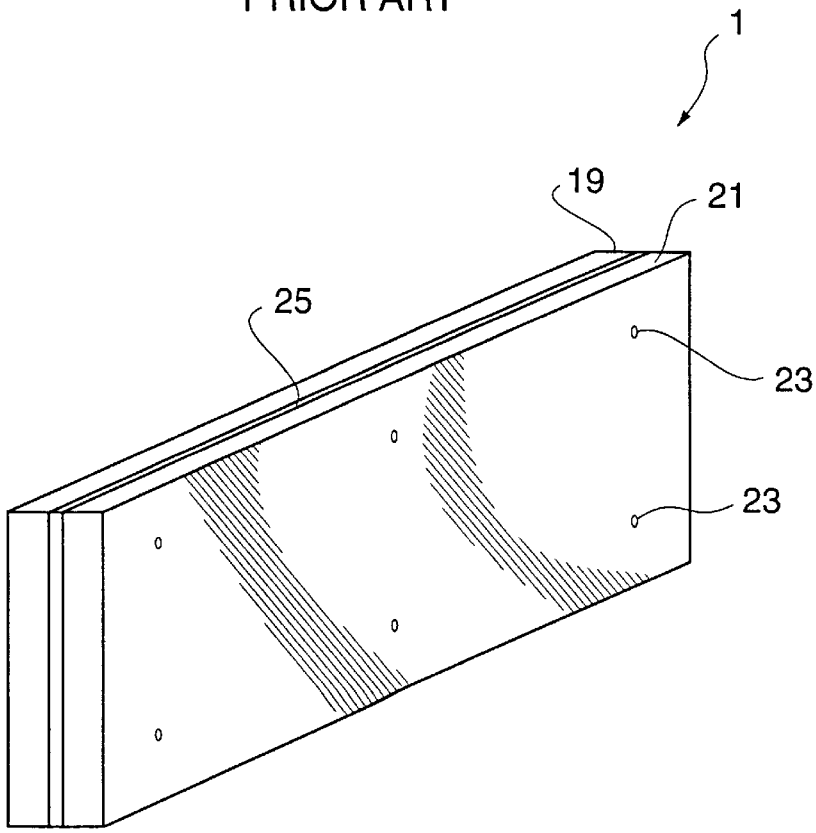
FIG. 2 PRIOR ART
FIG. 2 is a perspective view of the FIG. 1 prior art header showing the joined boards forming the header.

FIG. 2 is a perspective view of the FIG. 1 prior art header 1 showing the joined boards forming the header. The two 2 by 12 boards 19 and 21 (actually 1.5 inches by 11.5 inches) are fastened together by the spaced nails 23 with the chip board 25 sandwiched between them. All three facing boards would have approximately the same surface areas where they bear against one another. The chip board 25, like a plywood or fiberboard, can be made of bonded chips of wood and is considerably thinner in width (0.5 inch) than the width (1.5 inches) for each of the outer header forming boards 19 and 21. The overall length of the header is determined by the width of the opening and the distance between the wall studs to be spanned as shown in FIG. 1. Considerable material, time and labor is needed to construct the many headers needed for a typical home under construction. In addition, normally two workman are needed to raise the header one into position while it is installed to the wall studs. The present invention seeks to not only greatly reduce the material needed and the cost of these headers, by a factor of 3, but also to provide for a much lighter weight header that can easily be installed by one workman. As our header is prefabricated there will be more uniformity in its construction with most of the amount of on site labor and related cost to the contractor to construct the header eliminated.

Figure 3:
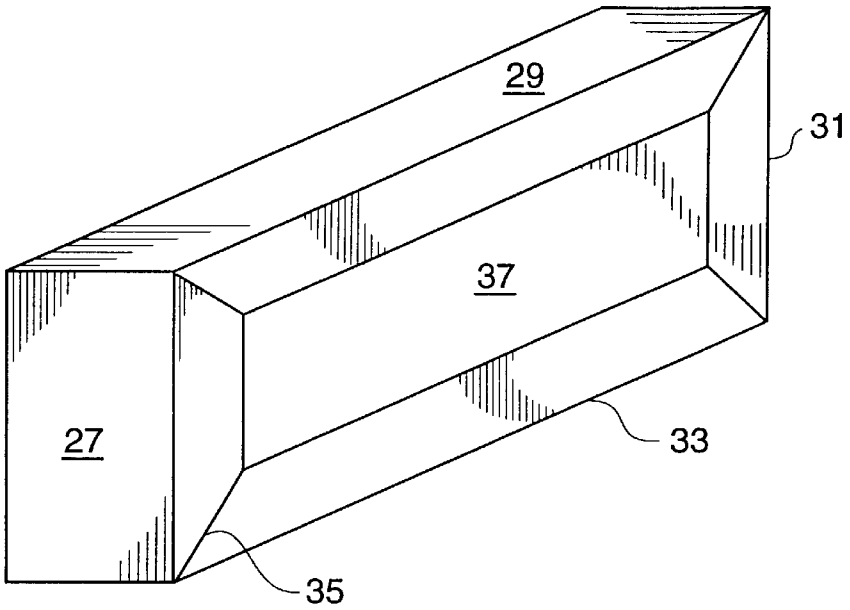
FIG. 3 is a perspective view of the assembled header used in the present invention.

FIG. 3 is a perspective view of the assembled header used in the present invention. The outer framing boards joined together to form a frame consists of the four boards designated by the numbers 27,29,31 and 33. In one embodiment each of these four boards was a 2 by 4 (actual measurements 1.5 by 3.5 inches). The two end piece opposite framing boards, 27 and 31, were each cut to a length of 11.5 inches one of the same dimensions as in a 2 by 12 board. The other two opposite framing boards, 29 and 33, used for the top and bottom, respectively, of the header are each cut to the required spanning length depending on the width of the door or window opening. All four framing boards have there butting ends cut on a 45 degree angle 35. When joined together in a rectangular configuration the four framing boards resemble a picture frame.

With the inner confines of the frame formed by the boards 27,29,31 and 33 are two identical rigid chip board sheets 37, one of which is shown on the near side the other being on the directly opposite side. As will be clearer from FIG. 5 and its descriptive material, each of the two chip boards 37 is mounted along its four edges in the longitudinal framing member grooves that run along the inner length of each framing board.

Figure 4:
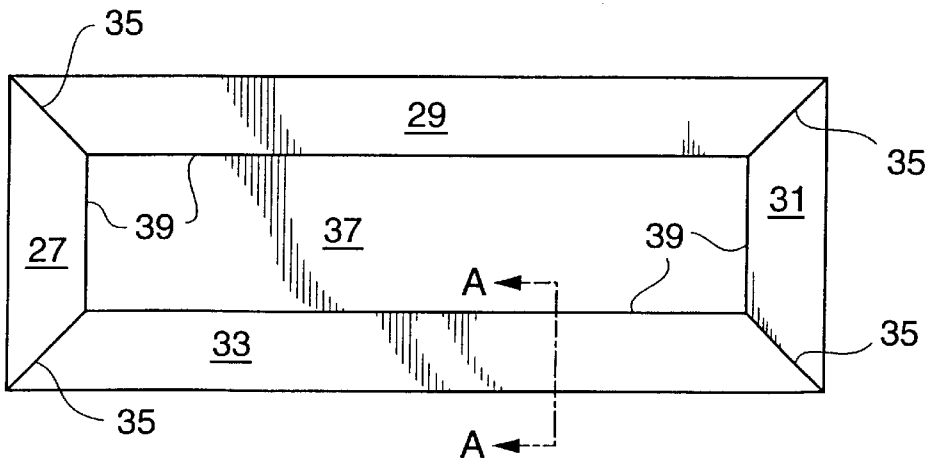
FIG. 4 is a front view of the header shown in FIG. 3 used in the present invention.

FIG. 4 is a front view of the header shown in FIG. 3 used in the present invention. In this view the rectangular configuration formed by the four framing boards is evident along with their four 45 degree angles 35 where joined at their butting ends. The inner shorter lengths for the four framing boards, represented by the numbers 39 also form a rectangular perimeter that extends around the chip board 37 on all of its sides.

Figure 5:
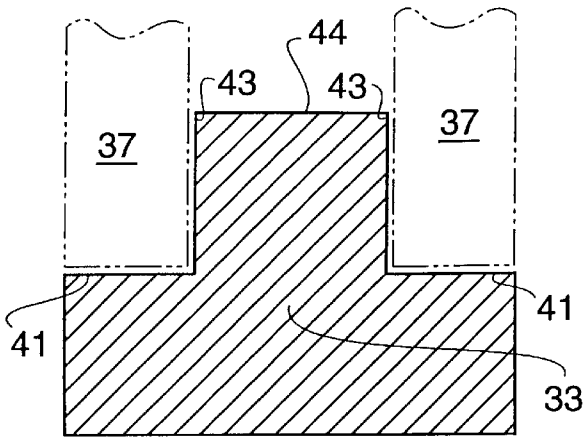
FIG. 5 is a cross-sectional view of one of the header framing members taken along line A—A of FIG. 4.

FIG. 5 is a cross-sectional view of one of the header framing members 33 taken along line A—A of FIG. 4. The other three framing boards (27,29 and 31) would have the same cross sectional shapes along their respectively lengths with the confines of the inner rectangular frame designated by the numbers 39. Each of the four framing boards are grooved at a right angles on opposite side surfaces along their lengths as represented by the horizontal surface 41 which intersect with the vertical surfaces 43. The lengths of surfaces 41 are the same and are equal to the width of the chip boards 37 (shown in dotted line format). The two vertical surfaces 43 for the grooves also have the same lengths which are greater than the length of the surfaces 41, For example, if the length of the cuts forming the lengths 41 were ½ inch on a 2 by 4 board, then the length of the cuts forming the surface length 43 would be ¾ of an inch each. The lower edges of the two chip boards 37 would each rest on the surfaces 41 and 43 with the top framing board surface 44 in between them.

Figure 6:
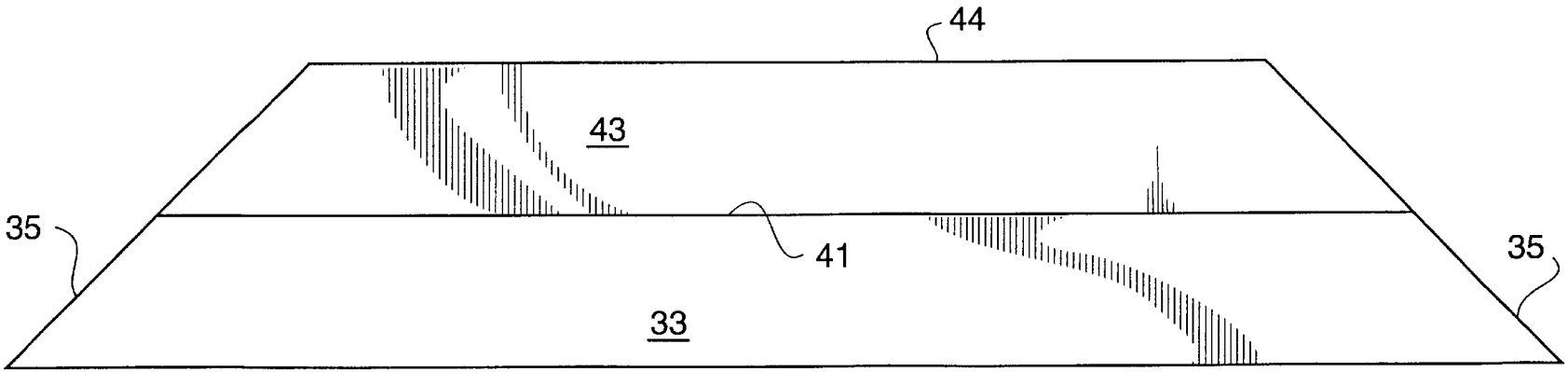
FIG. 6 is a side view of one of the framing boards.

FIG. 6 is a side view of one of the four framing boards. The three other framing boards (27,29 and 31) would have the same general outer configurations with the lengths of the top board 29 being equal to that of the board 33. The other two end framing boards (27 and 31) would be mirror images of each other with the same lengths. Each framing board would have two lengthwise grooves running along opposites as defined by the intersecting horizontal and vertical surfaces 41 and 43. These formed framing grooves act as seats for the chip board edges that rest upon them when the header is fully assembled.

Figure 7:
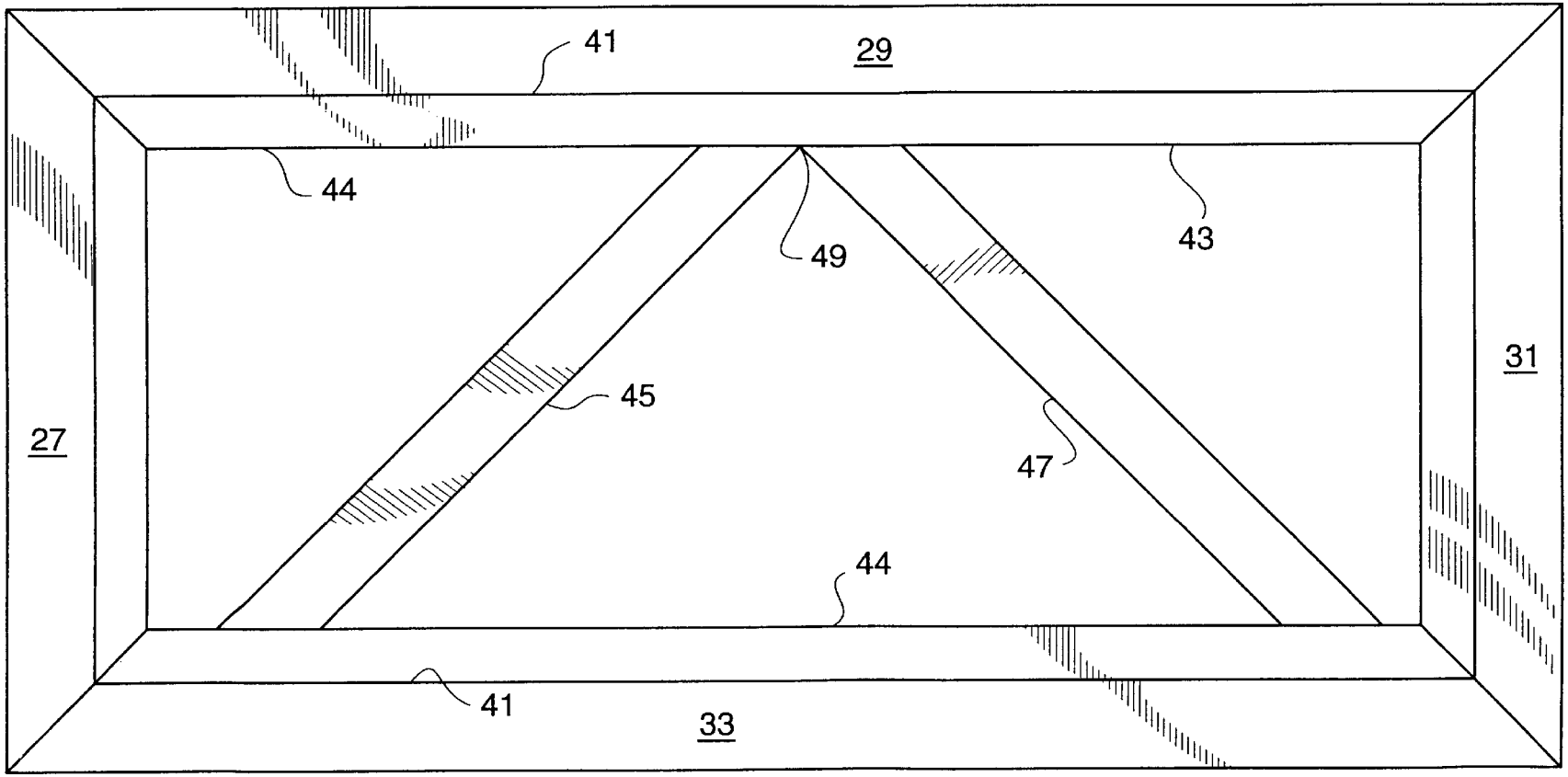
FIG. 7 is a front view of the assembled header framing member after the interior webbing supports have been added.

FIG. 7 is a front view of the assembled header framing member after two interior webbing supports 45 and 47 have been added. These webbing supports are added to the joined four frame board members 27,29,31 and 33 before the covering chip boards 37 are fixed in placed to cover the wedding on both sides. The interior support webbing boards 45 and 47 have angled end cuts to lie flush against the inner top surfaces 44 (see FIG. 5) of the two framing members 29 and 33. The tops of these webbing supports meet approximately in the middle 49 of the inner length of board 29 while the lower ends of the supports angle at about 45 degrees from their top ends and joined to the inner frame near their lower corners. The two opposite ends of each webbing board 45 and 47 are fixed by nails and glue to inner perimeter framing surfaces 44. The webbing provides the framing with great strength and allow the header to support very large loads. The thickness of each of the individual webbing boards 45 and 47 is no greater than the length of surface 44 and in the example give was 2.5 inches. After the support webbing is fixed to the inner surfaces of the four framing boards, the two facing sheets forming the chip boards 37, each ½ inch thick, are cut to the desired height and length. In one mentioned example this would be a height of 10 inches with a length determined by the spanning distance of the header. Finally, the two chip boards are nails and glued in the framing grooves on each of their four sides. The resultant header formed is not only very strong but a light weight unit (about half the weight of the described same length and height prior art header) and easily handled by one worker. Further, since less material lumber is used in the manufacturer of the present invention than conventional 2 by 12 headers there is a considerable savings in both lumber used and the cost to make the headers.

Materials other than wood products could conceivably be used to make the headers of this invention. Cost factors and the inherent strength characteristics of the particular materials chosen would dictate the selection of materials.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A load-bearing header comprising:

a plurality of framing members, each of said framing members having two ends, each of said framing members being joined to the adjacent end of another framing member to form a closed frame structure with an inner opened perimeter, each of said framing members having two sets of inner grooves extending along the lengths of the framing members adjacent the inner opened perimeter, one of said two sets of grooves being on each side of each of the framing members;

a plurality of interior frame webbing members spanning and joined to the inner opened perimeter of the frame, each of said frame webbing members being oriented at an angle less than ninety degrees with respect to the framing members to which joined; and two rigid sheets of material one of which sheets is adapted to be fixedly secured within each of the two sets of framing members grooves in the inner opened perimeter on opposite sides of the framing members to cover the plurality of interior frame webbing members on both sides.

2. The header as claimed in claim 1, wherein there are four framing members joined in a rectangular configuration.

3. The header as claimed in claim 2, wherein the interior frame webbing members have a width which is less than the width of a framing member to which joined.

4. The header as claimed in claim 3, wherein each of said framing members, webbing members and rigid sheets of material are made of wood products.

5. The header as claimed in claim 4, wherein said framing members grooves extending a given width distance into the width of each framing member on opposite sides the framing member and said sheets of material have a thickness approximately the same as the width of the grooves into which fit.

6. The header as claimed in claim 5, wherein said framing members are made of boards that are approximately 1.5 inches high and 3.5 inches wide, said grooves extending approximately 0.5 inches into the width of each framing member board on opposite sides of the board with said sheets of material having a thickness the same as the width of the grooves into which the sheets are fit.

* * * * *